US008448787B1

(12) United States Patent
Chang

(10) Patent No.: US 8,448,787 B1
(45) Date of Patent: May 28, 2013

(54) HAND TOOL DISPLAY RACK

(76) Inventor: Fu-Shiong Chang, Taichung (TW)

( * ) Notice: Subject to any disclaimer, the term of this patent is extended or adjusted under 35 U.S.C. 154(b) by 0 days.

(21) Appl. No.: 13/439,882

(22) Filed: Apr. 5, 2012

(51) Int. Cl.
*B65D 85/20* (2006.01)
*B65D 73/00* (2006.01)

(52) U.S. Cl.
USPC ..... 206/378; 206/806

(58) Field of Classification Search
USPC . 206/349, 376, 378, 461, 493, 806; 211/70.6, 211/59.1
See application file for complete search history.

(56) References Cited

U.S. PATENT DOCUMENTS 5,740,911 A * 4/1998 Chou ..... 206/378
6,032,797 A * 3/2000 Kao ..... 206/378
6,581,894 B1 * 6/2003 Tong ..... 248/314
7,111,422 B2 * 9/2006 Wheeler ..... 40/617
7,121,031 B2 * 10/2006 Wheeler ..... 40/673
7,287,644 B2 * 10/2007 Chen ..... 206/378
7,527,150 B2 * 5/2009 Tong ..... 206/376
8,261,912 B1 * 9/2012 Ingrey-Senn ..... 206/378
8,336,710 B2 * 12/2012 Chang ..... 206/379
2005/0126943 A1 * 6/2005 Liu ..... 206/378

* cited by examiner

*Primary Examiner* — Jacob K Ackun

(57) ABSTRACT

A hand tool display rack includes a body having a rectangular end extending therefrom and an opening is defined through the rectangular end. Two protrusions extend from two outsides of the rectangular end and a block is located in the opening. The block is located corresponding to the protrusions. The body and the block is connected by a connection portion which protrudes beyond the rectangular end so that the user can easily cut the connection portion when picking the hand tool from the display rack.

9 Claims, 7 Drawing Sheets

HAND TOOL DISPLAY RACK

FIELD OF THE INVENTION

The present invention relates to a display rack, and more particularly, to a hand tool display rack having a block and connection portions which can be cut to separate the block from the body, so that the rectangular recess of the hand tool is separated from the protrusions.

BACKGROUND OF THE INVENTION

Many conventional hand tools have a rectangular recess and the display rack has specific design for being engaged with the rectangular recess. One of the known hand tool display rack is disclosed in U.S. Pat. No. 6,672,555 and comprises a board and a U-shaped fixing member which has a narrow end flexibly connected to the board. The disclosure has anti-theft feature, but the fixing member has an opening and lacks of supporting structure so that when the socket is pulled by force, the protrusion in the fixing member is easily disengaged from the recess in the socket due to the lack of supporting structure and the deformation of the fixing member. The socket can be separated from the display rack and taken away by unauthorized persons. Besides, when the narrow end of the fixing member is cut, the board and the fixing member are easily broken and the tool which is weight can easily drop and lost.

The present invention intends to provide a hand tool display rack which has strong structure and the display hand tool is secured.

SUMMARY OF THE INVENTION

The present invention relates to a hand tool display rack and comprises a body having a rectangular end extending therefrom and the rectangular end includes a U-shaped frame which has two ends connected to the body. An opening is defined between the two ends of the U-shaped frame. The U-shaped frame has a protrusion extending from at least one of two outsides thereof and a rectangular block is located in the opening. A gap is defined between the block and the U-shaped frame. The rectangular block is located corresponding to the protrusion and connected to the body by a connection portion which protrudes beyond the rectangular end and can be cut by the users.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
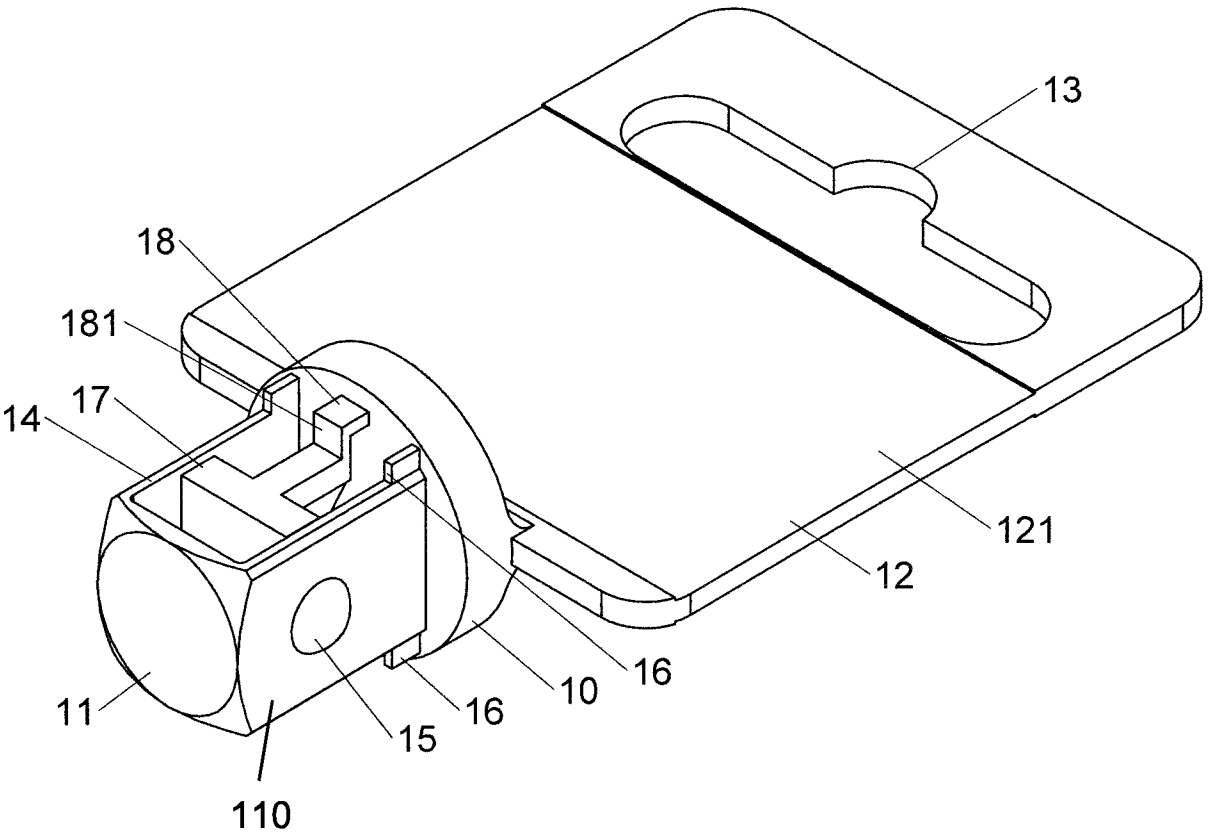
FIG. 1 is a perspective view to show the hand tool display rack of the present invention.

Referring to FIG. 1, the hand tool display rack of the present invention comprises a body 10 having a rectangular end 11 extending therefrom and the rectangular end 11 has a U-shaped frame 110 which has two ends connected to the body 10. A plate 12 is connected to the body 10 and located opposite to the rectangular end 11. The plate 12 has a front face 121 on which logos can be connected or printed thereon. The plate 12 has a hanging hole 13 defined therethrough and located close to the top edge thereof. An opening 14 is defined between the two ends of the U-shaped frame 110. The axis of the opening 14 is the same as the direction that the front face 121 faces. The U-shaped frame 110 has a protrusion 15 extending from at least one of two opposite outsides thereof. The rectangular end 11 is engaged with the rectangular recess of a hand tool such as the socket, the extension rod, the adapter or the universal head. The protrusion 15 is engaged with the recess in the rectangular recess of the hand tool. A first stop 16 extends from the U-shaped frame 110 and is located on the body 10. A rectangular block 17 is located in the opening 14 and connected to the body 10 by a connection portion 18. A gap is defined between the rectangular block 17 and the U-shaped frame 110. The protrusion 15 is located corresponding to the rectangular block 17. The body 10 and the rectangular block 17 are connected to each other by the connection portion 18 and a second stop 181 which is located between the block 17 and the connection portion 18. The connection portion 18 and the second stop 181 protrude beyond the rectangular end 11. The connection portion 18 and the second stop 181 are perpendicularly connected to each other, and the second stop 181 and the block 17 are perpendicularly connected to each other. The underside of the second stop 181 and the underside of the first stop 16 are located on the same plane. In this embodiment, the body 10, the rectangular end 11, the plate 12, the protrusion 15, the first stop 16, the block 17, the connection portion 18 and the second stop 181 are made integrally to each other. The body 10 is made by way of plastic or rubber, or other injection molding.

Figure 3:
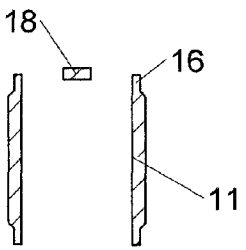
FIG. 3 is a cross sectional view, taken along line A-A in FIG. 2.
Figure 4:
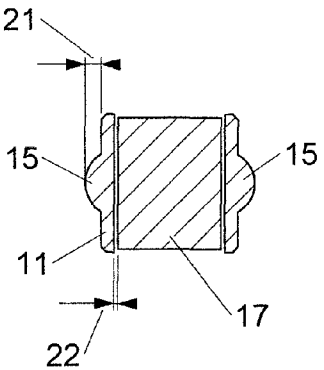
FIG. 4 is a cross sectional view, taken along line B-B in FIG. 2.
Figure 2:
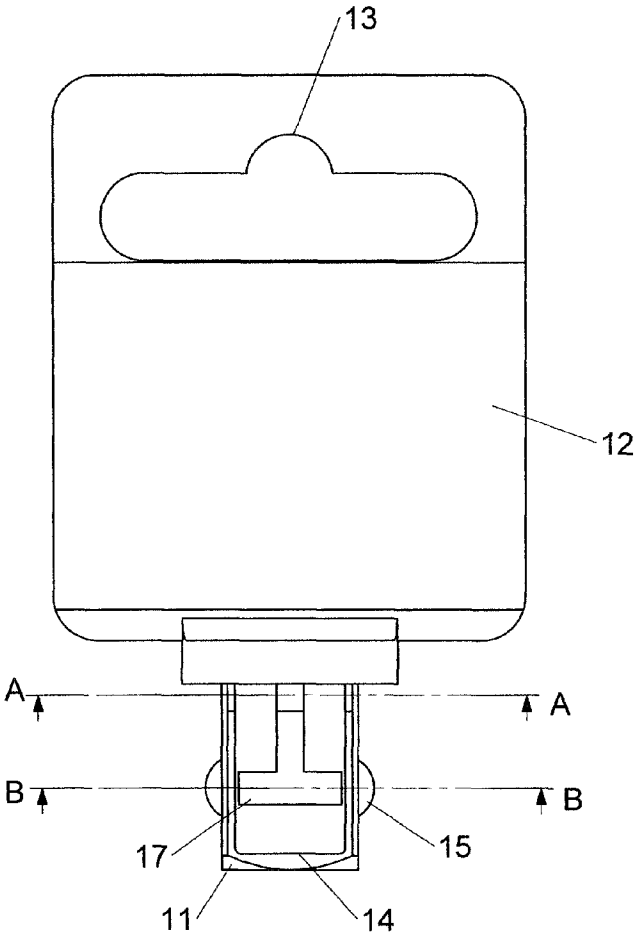
FIG. 2 is a top view to show the hand tool display rack of the present invention.

As shown in FIGS. 2 to 4, the height of the protrusion 15 is the first distance 21, and the second distance 22 is defined between the opening 14 and the block 17. The second distance 22 is less than the first distance 21. The second distance 22 is half of the first distance 21. When the rectangular end 11 is engaged with the rectangular recess of the hand tool, the end of the rectangular recess of the hand tool contacts the first and second stops 16, 181, the connection portion 18 is exposed beyond the hand tool and can be cut by the users.

Figure 5:
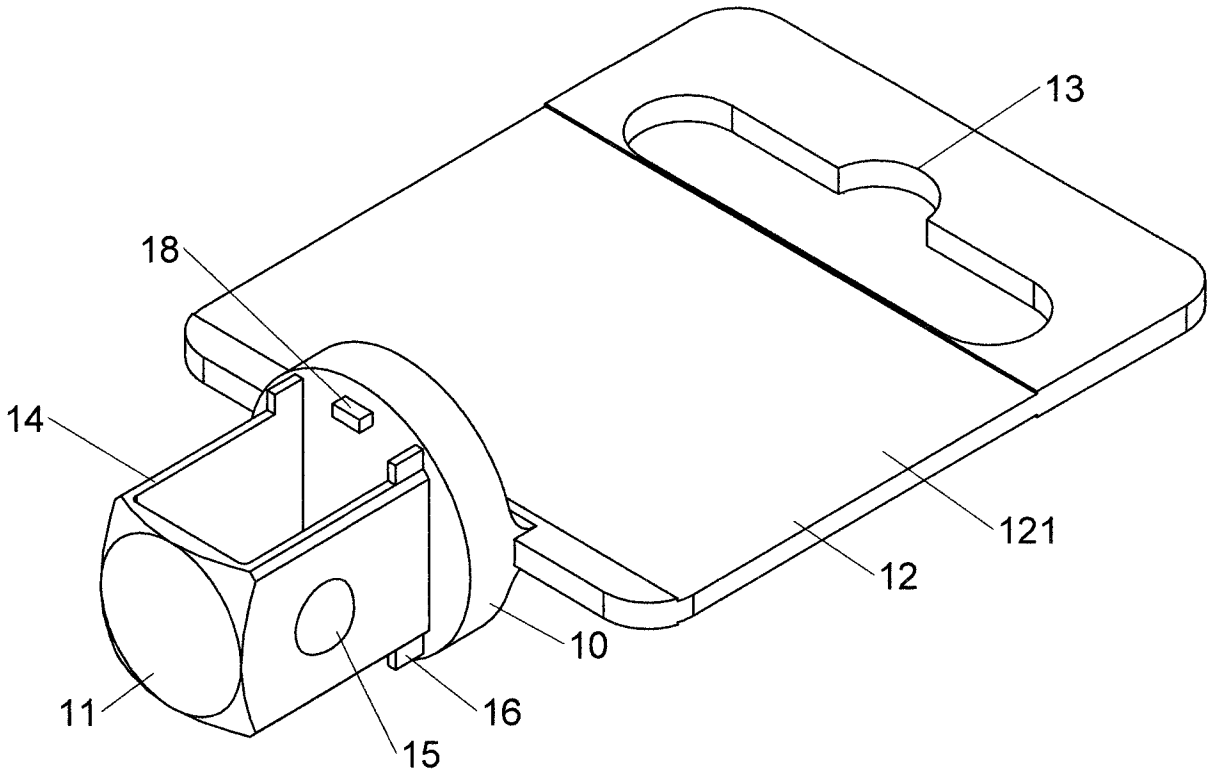
FIG. 5 shows that the block is removed from the rectangular end of the hand tool display rack of the present invention.

As shown in FIG. 5, the hand tool is forcibly mounted to the rectangular end 11 and the protrusion 15 is restricted by the block 17 and cannot be compressed inward. When the hand tool is to be removed from the display rack, the connection portion 18 is cut, so that the block 17 is removed from the body 10 and the protrusion 15 is not located corresponding to the block 17. The protrusion 15 is resilient and can be compressed inward because of the deformation of the rectangular end 11. The rectangular recess of the hand tool is able to be disengaged from the rectangular end 11 and the hand tool is removed. After the connection portion 18 is cut, the rectangular end 11 and the protrusion 15 can be engaged with the rectangular recess and the recess of the hand tool to connect the hand tool to the rectangular end 11 again. However, in this status, the display rack does not have anti-theft feature and is in normal usage for users.

Figure 6:
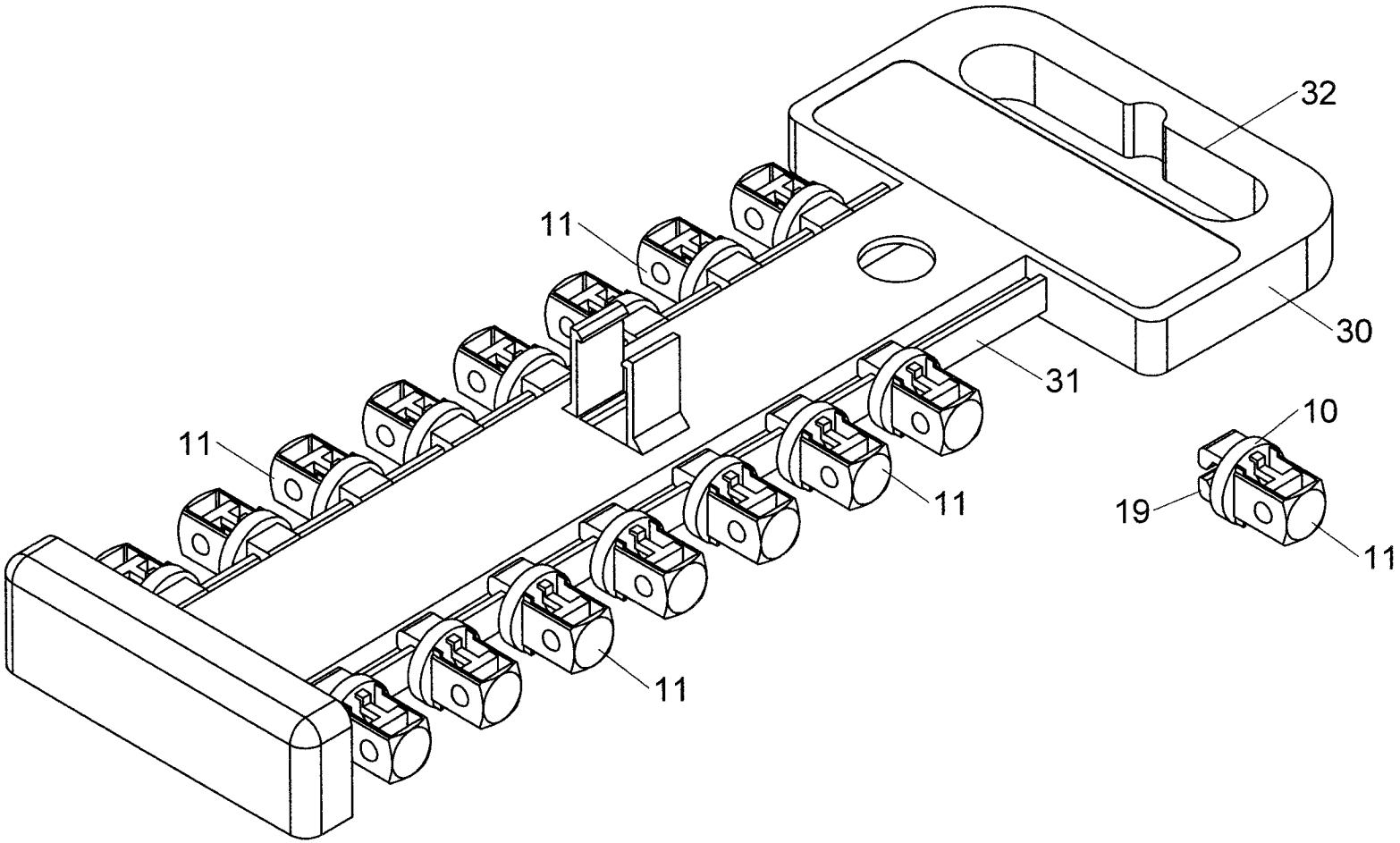
FIG. 6 is a perspective view to show the second embodiment of the hand tool display rack of the present invention.

FIG. 6 shows the second embodiment of the hand tool display rack of the present invention, wherein the plate 12 has a rail 31 which has a T-shaped cross section. A handle 32 is connected to the plate 12 so as to hang the display rack on a wall or carry the display rack. There are multiple bodies 10 and each body 10 has an engaging portion 19 which is engaged with the rail 31. The plate 12 is equipped with multiple bodies 10 so as to connect multiple hand tools.

Figure 7:
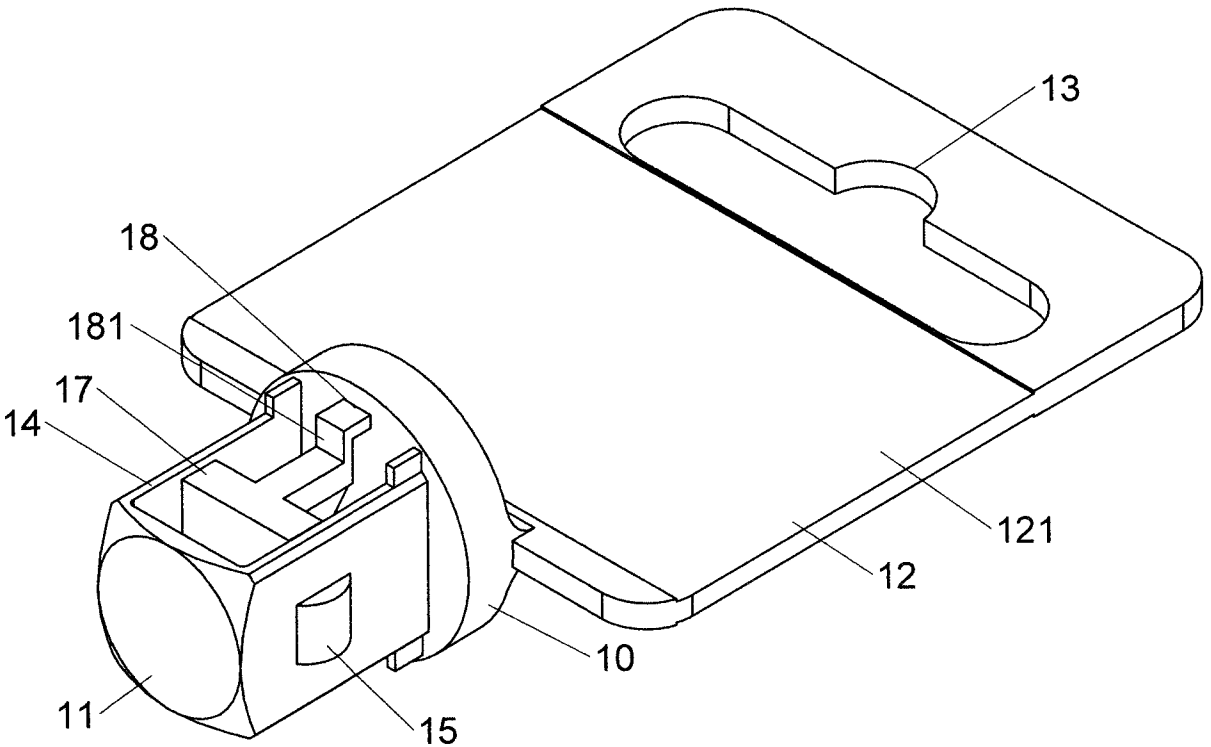
FIG. 7 is a perspective view to show the third embodiment of the hand tool display rack of the present invention.

FIG. 7 shows the third embodiment of the hand tool display rack of the present invention, wherein the protrusion 15 is a rectangular and rounded protrusion.

Figure 8:
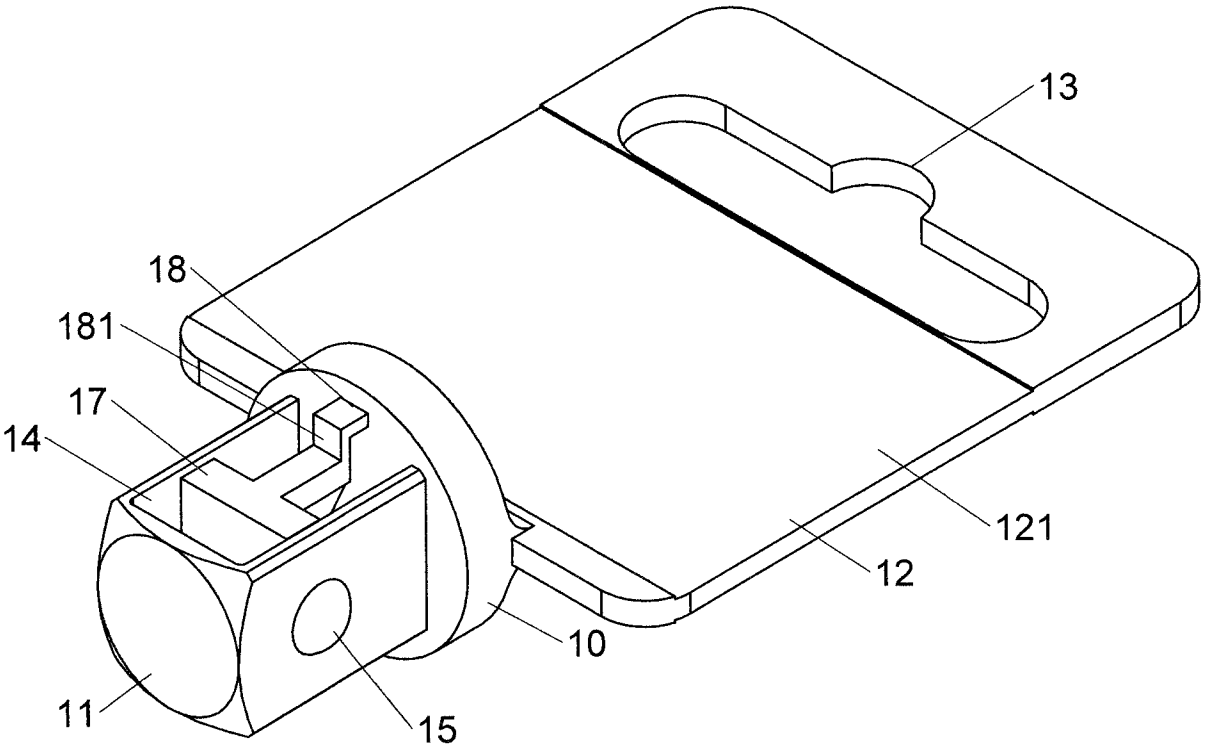
FIG. 8 is a perspective view to show the fourth embodiment of the hand tool display rack of the present invention.

FIG. 8 shows the fourth embodiment of the hand tool display rack of the present invention, wherein the body 10 does not have the first stop 16.

Figure 9:
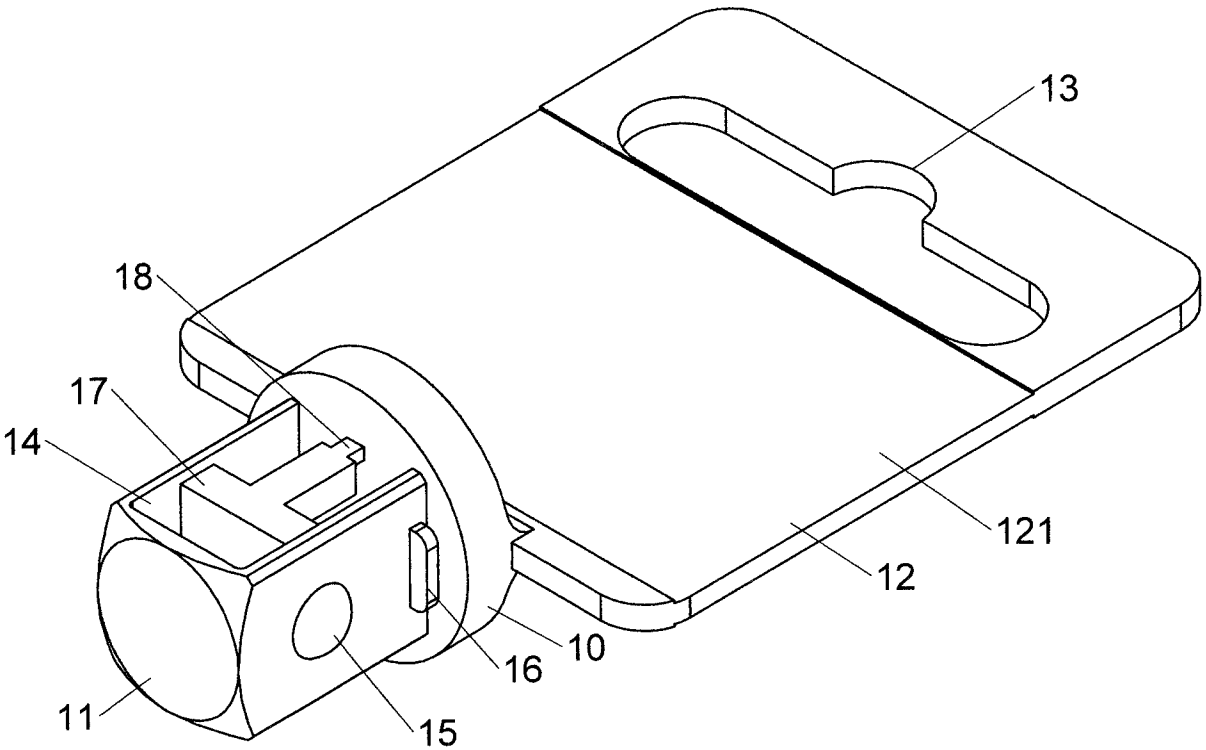
FIG. 9 is a perspective view to show the fifth embodiment of the hand tool display rack of the present invention.

FIG. 9 shows the fifth embodiment of the hand tool display rack of the present invention, wherein there are two first stops 16 on two outsides of the rectangular end 11. One of the first stops 16 and the protrusion 15 are located on the same outside of the rectangular end 11. The first stops 16 each are a longitudinal block. A gap is defined between the first stop 16 and the body 10.

The rectangular end 11 is engaged with the rectangular recess of the hand tool, and the protrusion 15 is restricted by the block 17 and cannot be compressed inward. When the rectangular end 11 is engaged with the hand tool such as a socket or an extension rod, the protrusion 15 is not compressed inward when the socket or the extension rod is pulled downward, so that the socket or the extension rod is not separated from the rectangular end 11 to have anti-theft feature.

The body 10 and the rectangular block 17 are connected to each other by the connection portion 18 and the second stop 181. When the rectangular end 11 is engaged with the hand tool such as a socket or an extension rod, by cutting the connection portion 18, the block 17 is separated from the body 10. The protrusion 15 is not located corresponding to the block 17. The protrusion 15 is resilient and can be compressed inward. The rectangular recess of the hand tool is able to be disengaged from the rectangular end 11 and the hand tool is removed.

After the connection portion 18 is cut, the rectangular end 11 can be engaged with the rectangular recess of the hand tool to connect the hand tool to the rectangular end 11 again. There are two connection areas between the rectangular end 11 and the body 10, so that the rectangular end 11 is not bent, and the hand tools can be connected to the body 10 when needed.

When the rectangular end 11 is engaged with the hand tool, the end wall of opening of the hand tool is in contact with the first and second stops 16, 181 so that the connection portion 18 protrudes beyond the hand tool and can be easily cut. During the cutting, the hand tool does not be damaged.

The block 17 has a rectangular head which restricts the protrusion 15 to provide better anti-theft feature.

The axis of the opening 14 is the same as the direction that the front face 121 faces so that the body 10 is easily molded by the top mold and the bottom mold, wherein no slide blocks are needed on the top and bottom molds so that the expense of the molds is reduced.

While we have shown and described the embodiment in accordance with the present invention, it should be clear to those skilled in the art that further embodiments may be made without departing from the scope of the present invention.

What is claimed is:

1. A hand tool display rack comprising:

a body having a rectangular end extending therefrom and the rectangular end having a U-shaped frame which has two ends connected to the body, an opening defined between the two ends of the U-shaped frame, a plate connected to the body and located opposite to the rectangular end, the U-shaped frame having a protrusion extending from at least one of two outsides thereof, a first stop extending from the U-shaped frame and located on the body, a rectangular block located in the opening and connected to the body by a connection portion and a second stop which is located between the block and the connection portion, a gap defined between the block and the U-shaped frame, the protrusion located corresponding to the block, the connection portion and the second stop protruding beyond the rectangular end, the connection portion and the second stop perpendicularly connected to each other, the second stop and the block perpendicularly connected to each other, an underside of the second stop and an underside of the first stop located on the same plane, a height of the protrusion being a first distance, a second distance being defined between the opening and the block, the second distance being less than the first distance.

2. The display rack as claimed in claim 1, wherein the plate has a front face for being printed with logos.

3. The display rack as claimed in claim 1, wherein the plate has a hanging hole.

4. The display rack as claimed in claim 1, wherein an axis of the opening is the same as a direction that the front face faces.

5. The display rack as claimed in claim 1, wherein the U-shaped frame has two protrusions 15 respectively on two outsides thereof.

6. The display rack as claimed in claim 1, wherein the plate has a rail which has a T-shaped cross section and the body has an engaging portion which is engaged with the rail.

7. The display rack as claimed in claim 1, wherein the protrusion is a rectangular protrusion.

8. The display rack as claimed in claim 1, wherein there are two first stops on two outsides of the rectangular end, one of the first stops and the protrusion are located on the same outside of the rectangular end, a gap is defined between the first stop and the body.

9. The display rack as claimed in claim 1, wherein the body, the rectangular end, the plate, the protrusion, the first stop, the block, the connection portion and the second stop are made integrally to each other.

* * * * *